US008134307B2

(12) United States Patent
Fontijn

(10) Patent No.: US 8,134,307 B2
(45) Date of Patent: Mar. 13, 2012

(54) METHOD, SYSTEM AND REMOTE CONTROL FOR CONTROLLING THE SETTINGS OF EACH OF A MULTITUDE OF SPOTLIGHTS

(75) Inventor: Wilhelmus Franciscus Johannes Fontijn, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 955 days.

(21) Appl. No.: 12/091,943

(22) PCT Filed: Oct. 27, 2006

(86) PCT No.: PCT/IB2006/053961

§ 371 (c)(1),
(2), (4) Date: Apr. 29, 2008

(87) PCT Pub. No.: WO2007/052197

PCT Pub. Date: May 10, 2007

(65) Prior Publication Data

US 2008/0290818 A1 Nov. 27, 2008

(30) Foreign Application Priority Data

Nov. 1, 2005 (EP) ..... 05110237

(51) Int. Cl.
*H05B 37/00* (2006.01)

(52) U.S. Cl. ..... 315/308; 315/307

(58) Field of Classification Search ..... 315/307, 315/308, 312, 291, 292
See application file for complete search history.

(56) References Cited

U.S. PATENT DOCUMENTS

| | | | | |
|---|---|---|---|---|
| 6,676,275 | B2 * | 1/2004 | Westhofen | 362/249.01 |
| 6,965,205 | B2 * | 11/2005 | Piepgras et al. | 315/318 |
| 7,332,877 | B2 * | 2/2008 | Crodian et al. | 315/297 |
| 7,355,523 | B2 * | 4/2008 | Sid | 340/9.16 |
| 2003/0020595 | A1 * | 1/2003 | Wacyk | 340/3.5 |
| 2003/0107888 | A1 | 6/2003 | Devlin et al. | |
| 2004/0178750 | A1 | 9/2004 | Belliveau | |

FOREIGN PATENT DOCUMENTS

| | | | |
|---|---|---|---|
| CH | 671821 | A5 | 9/1989 |
| EP | 0591899 | A1 | 4/1994 |
| WO | WO2004057927 | A1 | 7/2004 |

* cited by examiner

*Primary Examiner* — Douglas W Owens
*Assistant Examiner* — Minh D A
(74) *Attorney, Agent, or Firm* — Mark L. Beloborodov

(57) ABSTRACT

Method for controlling the settings of each of a multitude of spotlights, such as light intensity, color and light beam direction, wherein a remote control is used for sending control signals to a control system comprising a multitude of control units for changing the settings of said multitude of spotlights to desired values, which control units are each associated with one of said multitude of spotlights, wherein said control units can change the settings of their associated spotlights to the desired values, wherein each of said multitude of spotlights is radiating a unique light signal which is superimposed on its light beam, wherein the remote control comprises a sensor for determining said unique light signal, wherein the remote control sends with said control signal a spotlight identifying signal associated with the determined unique light signal as determined at the time that the remote control is used, and wherein the control unit associated with said spotlight identifying signal reacts to the combined spotlight identifying signal and control signal by changing its associated spotlight's settings to the desired values.

6 Claims, 1 Drawing Sheet

METHOD, SYSTEM AND REMOTE CONTROL FOR CONTROLLING THE SETTINGS OF EACH OF A MULTITUDE OF SPOTLIGHTS

The invention relates to a method for controlling the settings of each of a multitude of spotlights, such as light intensity, colour and light beam direction, wherein a remote control is used for sending control signals to a control system comprising a multitude of control units for changing the settings of said multitude of spotlights to desired values, which control units are each associated with one of said multitude of spotlights, and wherein said control units can change the settings of their associated spotlights to the desired values. The term "spotlight" in this respect must be interpreted broadly, and may also include atmospheric support lights, such as glowing walls, wide beam lamps etc.

As lamps and lamp fittings acquire more options like colour of the light and direction of the beam, setting and controlling these options becomes an issue. For instance, lamps may be mounted in such a way that changing the direction of the light is possible. This may be done using actuators that change the direction of the lamp holder if instructed to do so, or by using a movable mirror. Connecting all lighting devices to a central point and setting options from there is a possibility but is neither convenient nor intuitive. The use of a remote control is desired, so that the settings can be checked while working under the spotlights, using the remote control.

The invention therefore aims at a comfortable and reliable method for controlling the settings of a multitude of spotlights.

According to the invention each of said multitude of spotlights radiates a unique light signal which is superimposed on its light beam, wherein the remote control comprises a sensor for determining said unique light signal, wherein the remote control sends with said control signal a spotlight-identifying signal associated with the determined unique light signal as determined at the time that the remote control is used, and wherein the control unit associated with said spotlight-identifying signal reacts to the combined spotlight-identifying signal and control signal by changing the settings of its associated spotlight to the desired values.

A control unit in this respect is defined as comprising any mechanical actuators and electronic components (such as a ballast and/or a dimming unit) that are spotlight specific and are necessary to change and maintain said settings of its associated spotlight, as well as any circuitry and processing components that are necessary to process the remote control signals and translate those into instructions for said mechanical actuators and electronic components. The circuitry and processing components of said multitude of control units may well however be (partly) housed in one housing, and may even be implemented by software in one processor unit. Said control units hence need not be entirely separate entities in a physical sense. The term control system in this respect is defined as comprising all of said control units as well as any additional circuitry and electronic components that are needed to process the remote control signals and are common to all the control units and their associated spotlights.

Although it may be implemented as such, it is not necessary that the remote control actually sends two separate signals, one being a spotlight-identifying signal and one being a control signal. The combined spotlight-identifying signal and control signal which is sent by the remote control can be one combined control signal which is unique, and which triggers a specific action in only one of the control units associated with one of the spotlights. The control signal that is actually sent by the remote control in that case depends on both the control button that is pushed and the unique light signal that is determined by the sensor.

In a preferred embodiment said remote control and/or said control determine the absolute or relative movement of the remote control and change the beam direction of the associated spotlight such that the spotlight follows said movement. When sliding the remote control with the sensor out of the light beam while a special "follow" button on the remote control is pushed, the spotlight will follow the remote control and will try to keep the sensor in the centre of the beam. The user can thus effectively drag the light beam to its desired position. This can also be used to centre the light on a task on a desk or to focus light on a book that is being read. This preferred embodiment can be considered to be a separate invention as well, which is applicable also in a single spotlight system, and which invention also relates to a remote control comprising means for determining the absolute or relative movement or position of the remote control.

The invention also relates to a system for lighting an object, comprising a multitude of spotlights, a control system comprising a multitude of control units for changing the settings such as light intensity, colour and light beam direction of said multitude of spotlights to desired values, wherein each of said control units is associated with one of said multitude of spotlights for changing the settings of their associated spotlights to the desired values, and a remote control for sending control signals to said control units, wherein each control unit is arranged to let the spotlight radiate a unique light signal which is superimposed on its light beam, wherein the remote control comprises a sensor for determining said unique light signal, wherein the remote control is arranged to send with said control signal a spotlight-identifying signal associated with said unique light signal as determined at the time that the remote control is used, and wherein the control units are arranged to react to the combined spotlight-identifying signal associated with their associated spotlight and the control signal by changing the settings of their associated spotlight to the values which are determined by the control signal.

Furthermore the invention relates to a remote control for sending control signals to a multitude of control units, wherein the remote control comprises a sensor for determining a unique light signal, and wherein the remote control is arranged to send with said control signal an identifying signal associated with said unique light signal as determined at the time that the remote control is used.

The invention will be illustrated by means of a preferred embodiment with reference to the figures, wherein.

Figure 1:
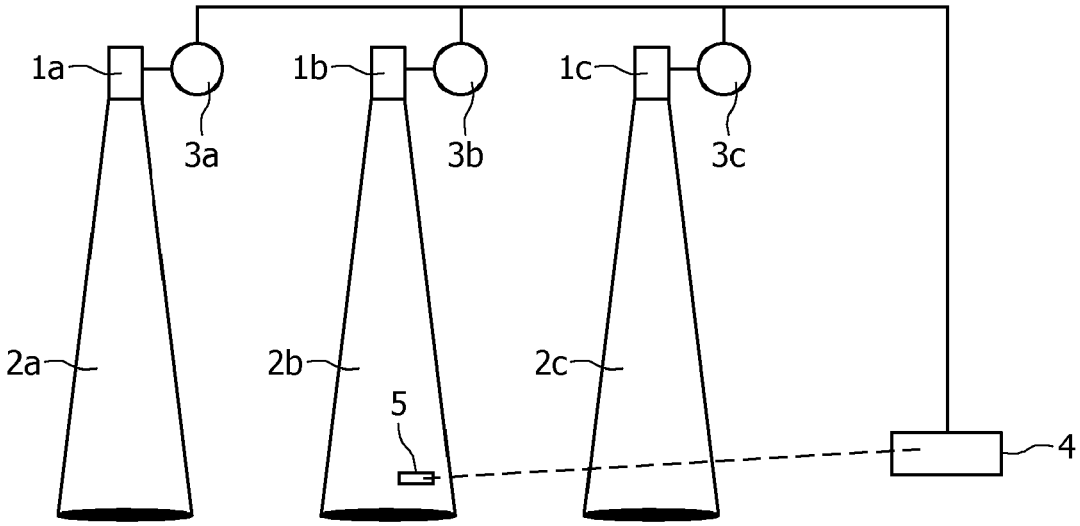
FIG. 1 shows schematically a system for lighting an object.

According to the schematic view of FIG. 1, a system for lighting an object, such as a living room, theatre stage, film studio or shop window, comprises a multitude of spotlights 1*a*, 1*b*, 1*c*, which are typically mounted on a ceiling. Said spotlights 1*a*, 1*b*, 1*c* each cast a light beam 2*a*, 2*b*, 2*c* on the object. The spotlights 1*a*, 1*b*, 1*c* are each connected to a control unit 3*a*, 3*b*, 3*c*, which comprise actuators and electronic circuitry that can change the direction, intensity (on/off/dimming) and colour of the light beam 2*a*, 2*b*, 2*c*. The control units 3*a*, 3*b*, 3*c* are connected (wired or wireless) to a central control panel 4. The settings of the spotlights 1*a*, 1*b*, 1*c* can be individually changed in a known manner by a person using the control panel 4. According to the invention a remote control 5 can however be used as follows.

The remote control 4 comprises a light-sensitive pixel array, such as those used in a video camera, on its upper side. Each control unit sends with the light beam 2*a*, 2*b*, 2*c* a superimposed high frequency light signal, which is unique for each spotlight 1*a*, 1*b*, 1*c*, and which can be used to identify each of said spotlights 1*a*, 1*b*, 1*c*. The remote control 5 comprises means to analyse the video signal of the light-sensitive pixel array when a control button is pushed and to determine from said signal an identifying code (of the strongest light beam received), associated with one of said spotlights. In this case an identifying code for spotlight 1*b* will be determined when a button is pushed on the remote control 5.

The control signal that the remote control 5 sends to the control panel 4 depends on the combination of the button on said remote control 5 that is pushed by a person and the spotlight-identifying code that is determined by means of the light-sensitive pixel array, wherein each control signal is unique. In an alternative embodiment the remote control sends both a control signal that depends only on the button that is pushed and a spotlight-identifying signal that depends only on the spotlight-identifying code that is determined. Also in that case the combination of both signals can be considered to be one unique signal. The number of possible unique control signals that the remote control 5 can send is thereby as large as the number of buttons on the remote control multiplied by the number of spotlights in the system. It will be apparent that the control panel 4 translates the received control signals and sends the appropriate instruction signals to the control unit associated with the spotlight-identifying signal that was received by the remote control 5. Thus, in the situation of FIG. 1, when a person pushes the "brighter" button on the remote control, the system will determine that the person wants spotlight 1*b* to shine brighter and act in accordance therewith. If the person thereafter wants spotlight 1*c* to shine less bright, he must first move the remote control 5 under the beam 2*c* and then push the "darker" button. Alternatively, it is possible for a user to first define a group of spotlights based on the identifying codes received and stored in the remote control, and then change the settings of the entire group at the same time.

In an alternative embodiment the system does not comprise a central control panel 4, and in said embodiment the signal of the remote control 5 is directly received by the control units 3*a*, 3*b*, 3*c*. The control units are arranged such that only the control unit to which the control signal is addressed (i.e. the control signal comprises, or is associated with, the identifying signal of the spotlight that is associated with said control unit) will react to said control signal.

Figure 2A:
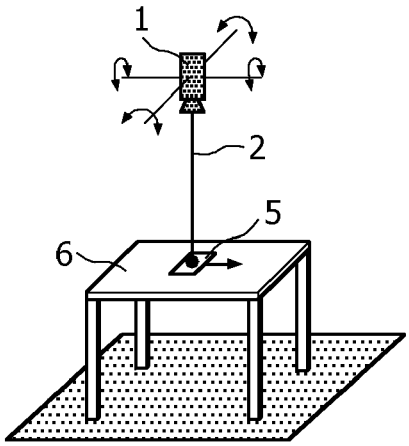
FIGS. 2A and 2B show schematically the use of a remote control to change the direction of a light beam.
Figure 2B:
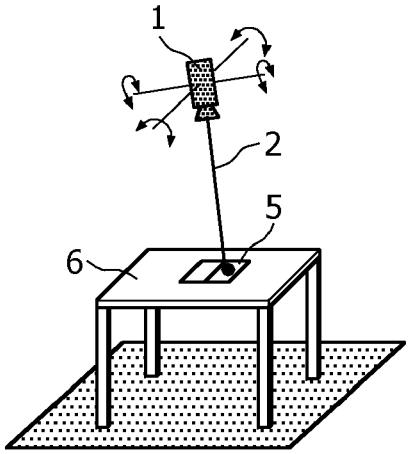

FIGS. 2A and 2B schematically illustrate a further use of the system. When sliding the remote control 5 with the light-sensitive pixel array on the table 6 out of the light beam 2 (represented here by a centre line) from a predetermined position while a special "follow" button on the remote control 5 is pushed, the remote control 5 can determine from the pixel image in which direction the remote control 5 is moved, and can calculate the change in angle relative to the spotlight. The spotlight 1 will follow the remote control 5 and will try to keep the light-sensitive pixel array on the remote control 5 in the centre of the beam 2. The user can thus effectively drag the light beam 2 to its desired position.

In another embodiment of the invention the remote control comprises an accelerometer and an (electromagnetic, digital) compass in order to determine the relative movement of the remote control. Also an (optical) mouse principle, well known for moving a cursor on a computer screen, can be used to determine said relative movement. In yet another embodiment, wherein the absolute movement of the remote control is determined and which allows greater freedom of movement thereby, the control system comprises beacons that are positioned at fixed positions and which can be used to determine the absolute position of the remote control. Ultrasound or video-imaging can for instance be used to determine its position relative to said beacons in such embodiments. It will be appreciated that various means for determining the relative or absolute movement (or position) of the remote control are known and available, and that it is not considered appropriate to describe all those here.

The invention claimed is:

1. A method for controlling the settings of each of a multitude of spotlights, wherein a remote control is used for sending control signals to a control system comprising a multitude of control units for changing the settings of said multitude of spotlights to desired values, which control units are each associated with one of said multitude of spotlights, wherein said control units can change the settings of their associated spotlights to the desired values, wherein each of said multitude of spotlights radiates a unique light signal which is superimposed on its light beam, wherein the remote control comprises a sensor for determining said unique light signal, wherein said sensor comprises a light-sensitive pixel array, wherein the remote control sends with said control signal a spotlight-identifying signal associated with the determined unique light signal as determined at the time that the remote control is used, and wherein the control unit associated with said spotlight-identifying signal reacts to the combined spotlight-identifying signal and control signal by changing the settings of its associated spotlight to the desired values.

2. The method according to claim 1, wherein said remote control and/or said control system determine the absolute or relative movement of the remote control and change the beam direction of the associated spotlight such that the spotlight follows said movement.

3. The method of claim 1, wherein the settings of said multitude of spotlights are selected from the group consisting of: light intensity, color, and light beam direction.

4. A system for lighting an object, the system comprising a multitude of spotlights, a control system comprising a multitude of control units for changing the settings such as of said multitude of spotlights to desired values, and a remote control for sending control signals to said control units, wherein each of said control units is associated with one of said multitude of spotlights for changing the settings of their associated spotlights to the desired values, wherein each control unit is arranged to let the spotlight radiate a unique light signal which is superimposed on its light beam, wherein the remote control comprises a sensor for determining said unique light signal, wherein said sensor comprises a light-sensitive pixel array, wherein the remote control is arranged to send with said control signal a spotlight-identifying signal associated with said unique light signal as determined at the time that the remote control is used, and wherein the control units are arranged to react to the combined spotlight-identifying signal associated with their associated spotlight and the control signal by changing the settings of their associated spotlight to the values which are determined by the control signal.

5. The system according to claim 1, wherein said remote control and/or said control system comprise means for determining the absolute or relative movement of the remote control and are arranged to change the beam direction of the associated spotlight such that the spotlight follows said movement.

6. The system of claim 4, wherein the settings of said multitude of spotlights are selected from the group consisting of: light intensity, color, and light beam direction.

* * * * *